US005378113A

United States Patent [19]

Caldwell

[11] Patent Number: 5,378,113

[45] Date of Patent: Jan. 3, 1995

[54] APPARATUS FOR COMPRESSING GAS

[76] Inventor: Lynn Caldwell, Rte. 2, Box 159-1, Wetumka, Okla. 74883

[21] Appl. No.: 173,988

[22] Filed: Dec. 28, 1993

[51] Int. Cl.[6] ..... F04B 41/00

[52] U.S. Cl. ..... 417/236; 417/364

[58] Field of Search ..... 417/236, 364, 237; 123/560

[56] References Cited

U.S. PATENT DOCUMENTS

| | | | |
|---|---|---|---|
| 1,934,880 | 11/1933 | Pyk et al. | 417/364 |
| 2,133,769 | 10/1938 | Jones | 417/364 |
| 4,351,278 | 9/1982 | Gaschler et al. | 417/364 |
| 4,563,132 | 1/1986 | Grimmer | 417/364 |
| 4,565,167 | 1/1986 | Bryant | 123/560 |
| 4,700,663 | 10/1987 | Dunn | 417/237 |
| 4,961,691 | 10/1990 | Waldrop | 417/237 |
| 5,203,680 | 4/1993 | Waldrop | 417/364 |

OTHER PUBLICATIONS

Exhibit A–Receipt dated Feb. 1, 1993 showing when the apparatus to be patented was first leased for public use.

*Primary Examiner*—Richard A. Bertsch
*Assistant Examiner*—M. Kocharov
*Attorney, Agent, or Firm*—Craig W. Roddy

[57] ABSTRACT

An internal combustion engine having cylinders and a head assembly adapted for compressing gas, wherein one or more cylinders of an inline-cylinder engine are modified to compress flammable gas, such as natural gas. The engine cylinders and head assembly are adapted to compress gas by: modifying existing engine valves to secure compressor intake and discharge valves within the head assembly; converting engine pistons into compressor pistons; inserting filler plates into the head assembly; and replacing the engine manifold, which is in communication with the adapted cylinders, with gas intake and discharge manifolds.

26 Claims, 9 Drawing Sheets

APPARATUS FOR COMPRESSING GAS

BACKGROUND

The present invention relates generally to an apparatus for compressing gas, and more specifically, to an internal combustion engine adapted to compress flammable gases such as natural gas.

Other integral gas compressor and internal combustion engines adapted for use on flammable gases are known. For example, U.S. Pat. Nos. 4,961,691 and 5,203,680, both to Waldrop, disclose a V-shaped internal combustion engine having a portion thereof converted to a gas compressor. The Waldrop compressor is constructed by modifying a Ford V-8 engine having a first and second bank of cylinders wherein a compressor head is installed on the first bank of cylinders and an engine head is installed on the second bank of cylinders. Thus, the Waldrop patents disclose a V-shaped gas compressor that provides an engine to compression cylinder ratio of one to one.

The preferred version of the present invention provides an efficiently integrated gas compressor and internal combustion engine which is constructed from an engine having a single bank of inline cylinders and a modified original engine head installed thereon. Further, the preferred version is adapted to produce an engine to compression cylinder ratio of two to one wherein the engine cylinders have a four-cycle operation and the compressor cylinders have a two-cycle operation.

It is known that an integral gas compressor and internal combustion engine can be readily constructed from a V-shaped engine by adding a compressor head to one bank of cylinders; thus, providing an engine to compression cylinder ratio of one to one. However, known integral gas compressor and internal combustion engines are incapable of being constructed from an inline-cylinder engine having a modified engine head assembly. Further, known integral gas compressors do not provide a greater than one to one engine to compression cylinder ratio. Therefore, the present invention is economical and efficient because it utilizes a modified original engine head assembly and produces a greater than one to one engine to compression cylinder ratio.

Hence, there is a need for a simple, economical and effective apparatus for compressing gas which is produced from an inline-cylinder engine, has a modified engine head assembly for energizing and compressing cylinders, and produces a greater than one to one engine to compression cylinder ratio; however, until now, no such apparatus has been developed.

SUMMARY

The preferred embodiment of the invention is directed to a form of internal combustion engine with integrated gas compressor which provides a greater than one to one engine to compressor cylinder ratio and is well suited for use with flammable gases, such as natural gas.

The present version of the invention comprises a cylinder block having an inline bank of cylinders for energizing and compressing; a crankshaft rotatably disposed in the cylinder block; an engine piston reciprocally disposed in each energizing cylinder; a compressor piston reciprocally disposed in each compressor cylinder; a head attached to the cylinder block adjacent the inline bank of cylinders; and an engine manifold attached to the cylinder block. In addition, the preferred version includes first and second valve pockets located in the head adjacent each compressor cylinder; a compressor intake manifold in communication with each first valve pocket; a compressor discharge manifold in communication with each second valve pocket; means for sealing the compressor intake and discharge manifolds with the head; an intake compressor valve disposed in each first valve pocket; a discharge compressor valve disposed in each second valve pocket; an intake compressor valve securing means for securing the intake compressor valve in each first valve pocket; a gas intake flow path defined through the intake compressor valve securing means; a discharge compressor valve securing means for securing the discharge compressor valve in each second valve pocket; and a gas discharge flow path defined through the discharge compressor valve securing means.

The intake and discharge compressor valve securing means are each constructed by modifying an original engine valve that corresponds with each compressor cylinder. Modification of the original valves for either the intake or discharge compressor valve securing means includes: fashioning a threaded portion thereon to couple with a locknut for attaching the intake or discharge compressor valve securing means to the head; tapping the valves to couple with a threaded bolt for attaching either the intake or discharge compressor valve thereto; and defining a gas flow path therethrough for gas flow communication between the intake or discharge compressor manifold and the compressing cylinder via the respective intake or discharge compressor valve.

The preferred embodiment of the invention includes a means for sensing lubricating oil pressure and means for deenergizing the apparatus when the lubricating oil pressure drops below a predetermined level. Further, a venting means is used to prevent a buildup of gas in the apparatus.

A preferred method of constructing an apparatus for compressing gas comprises the steps of: providing an internal combustion engine having an inline bank of cylinders with engine pistons and an engine head assembly; removing the engine head assembly for modification into a combined engine and compressor head assembly; modifying an engine piston into a compressor piston; removing first and second engine valves which correspond with each compressor piston; modifying the first valve removed wherein the first valve is attached to an intake compressor valve, modified for attachment in the engine head assembly, and provided with a gas flow path therethrough; installing the modified first valve in the engine head assembly; modifying the second valve removed wherein the second valve is attached to a discharge compressor valve, modified for attachment in the engine head assembly, and provided with a gas flow path therethrough; installing the modified second valve in the engine head assembly; terminating the original engine manifold which leads to each cylinder having a compressor piston; manifolding a gas intake flow path in communication with each intake compressor valve; and manifolding a gas discharge flow path in communication with each discharge compressor valve.

As such, it is a first object of the embodiment of the invention to provide an efficient, economical, and simple apparatus for compressing gas such as natural gas.

It is a further object of the embodiment of the invention to provide an apparatus for compressing gas which is produced by modifying an internal combustion engine having a single inline bank of cylinders.

It is a further object of the embodiment of the invention to provide an apparatus for compressing gas which is constructed by modifying the original engine head assembly.

It is a further object of the embodiment of the invention to provide an apparatus for compressing gas which has a combined engine and compressor head assembly.

It is a further object of the embodiment of the invention to provide an apparatus for compressing gas which has energizing and compressing cylinders located in a single bank.

It is a further object of the embodiment of the invention to provide an apparatus for compressing gas which produces an engine to compression cylinder ratio greater than one to one.

It is a final object of the embodiment of the invention to provide an apparatus for compressing gas which is constructed from an internal combustion engine and is energized by a separate energizing means connected thereto.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1:
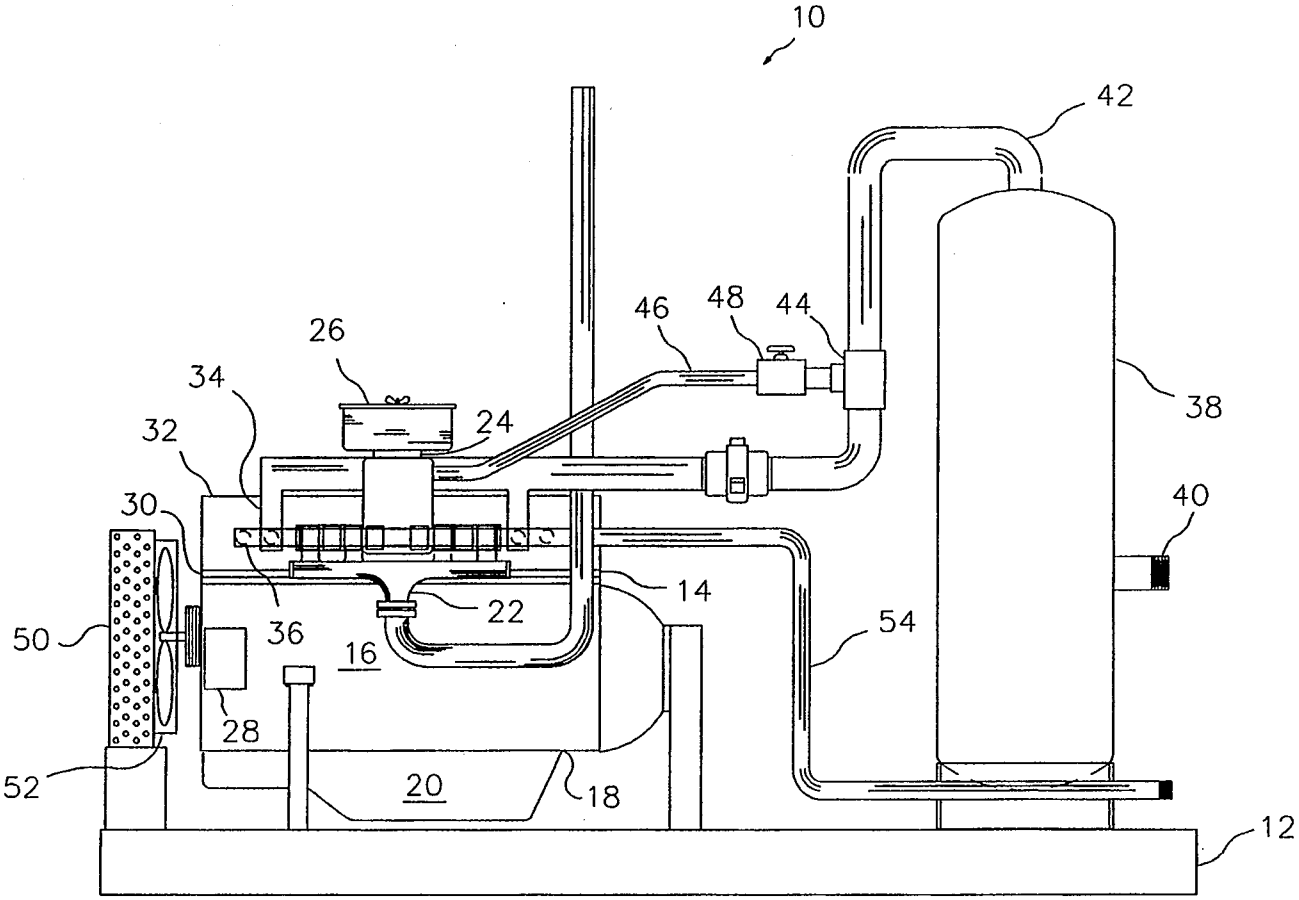
FIG. 1 is a side elevation view of the apparatus for compressing gas constructed in accordance with the present embodiment of the invention.
Figure 2:
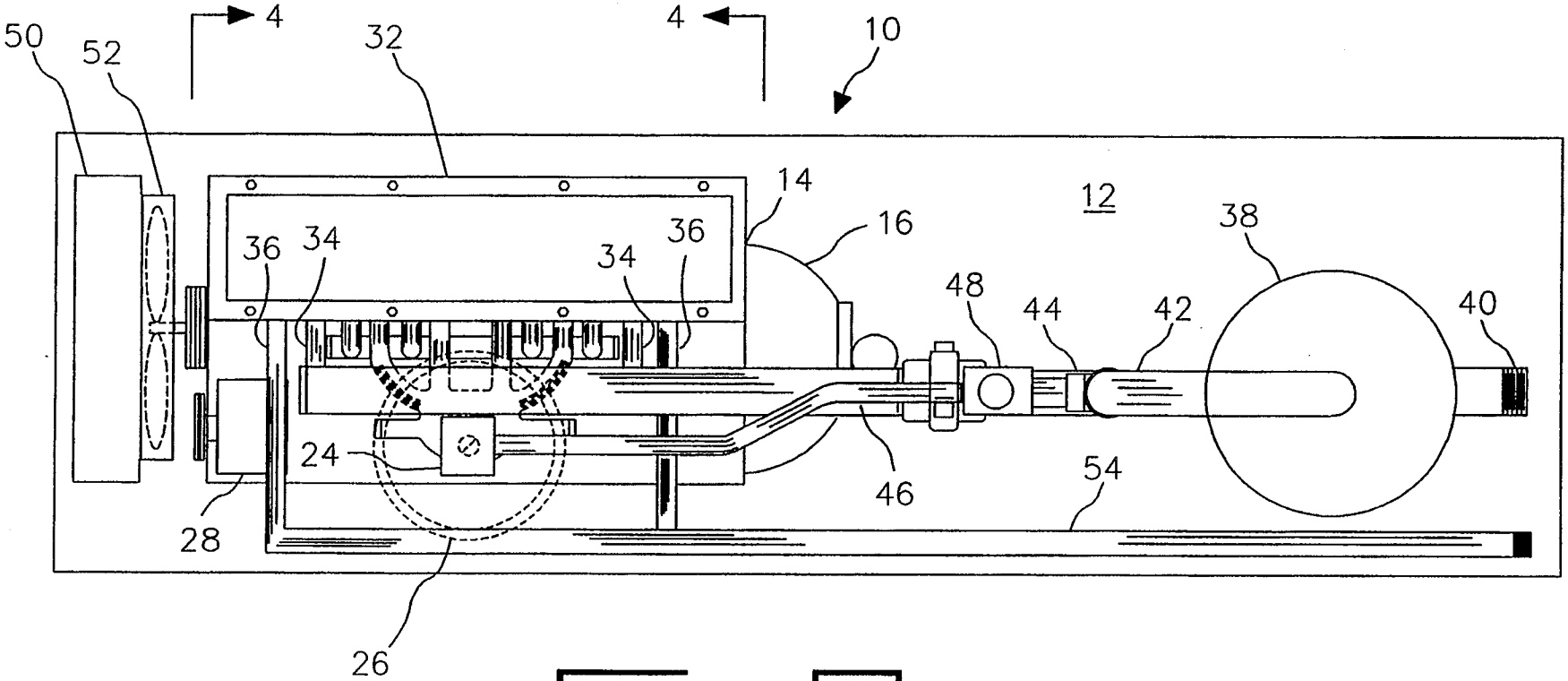
FIG. 2 is a top plan view of the apparatus for compressing gas.

As best illustrated in FIGS. 1 and 2, the preferred embodiment of the invention relates to an integral gas compressor and internal combustion engine 10, referred to generally as compressor 10, which is useful in compressing flammable gas, such as natural gas. U.S. Pat. No. 4,961,691 discloses a gas compressor and associated components which form a compressor package, wherein the associated components are commonly known in the art and are obviously adaptable for use with the present version of the invention.

The present embodiment of the invention is not intended to be limited to only those items illustrated herein, but rather, includes omitted items which are known in the art and are not necessary for understanding the present invention. Therefore, the figures have been greatly simplified to eliminate many of the known components associated with the compressor 10.

Referring again to FIGS. 1 and 2, the compressor 10 is mounted on a skid or baseplate 12 by a mounting means known in the art such as a plurality of bolts. The compressor 10 is preferably constructed by modifying a 225 cubic inch Chrysler slant-6 inline engine or other known internal combustion engine.

Figure 3:
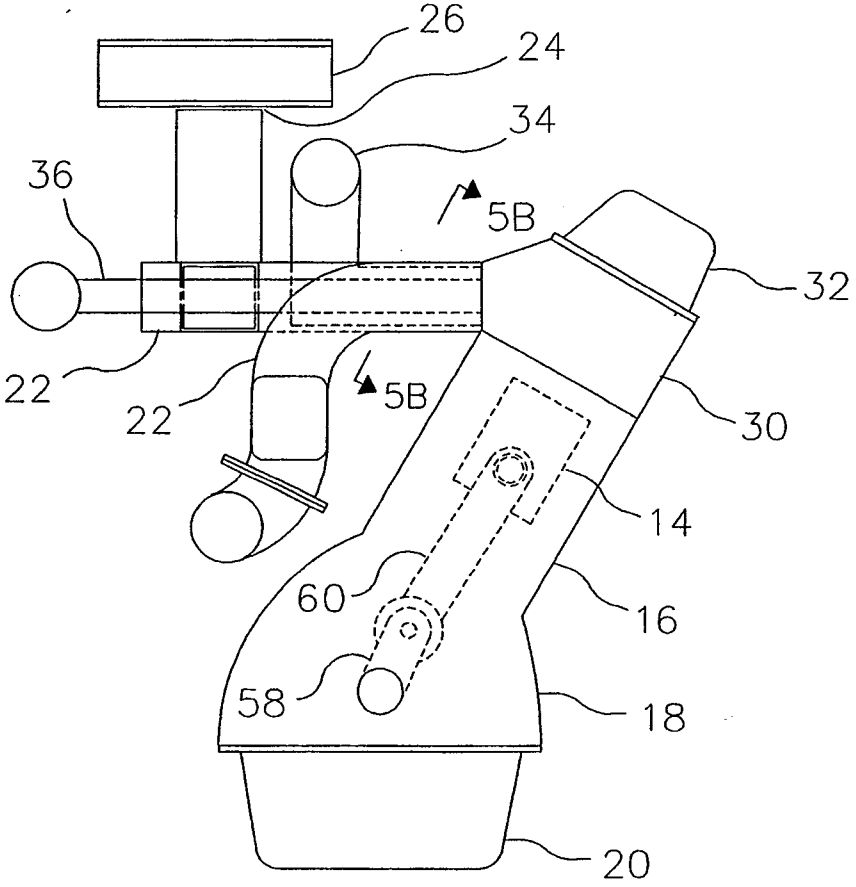
FIG. 3 is an end view of the internal combustion engine with integrated gas compressor constructed in accordance with the present embodiment of the invention.

As shown in FIGS. 2 and 3, the compressor 10 is constructed from an engine having a single bank of inline cylinders 14. The compressor 10 includes a cylinder block 16 with a crankcase 18 portion at the lower end thereof. Below the crankcase 18 is an oil pan 20. The cylinder block 16, crankcase 18 and oil pan 20 are standard components of the original engine. An upper end of the cylinder block 16 has an attached engine intake and exhaust manifold 22, a natural gas carburetor 24 and an air cleaner 26. The carburetor 24 is of a kind known in the art, such as an IMPCO, for use with natural gas. A governor 28, of a kind known in the art such as a belt drive type, is attached to the cylinder block 16 for regulating the speed of the compressor 10.

Connected to the cylinder block 16 on the inline bank of cylinders 14 is a standard engine head assembly 30 which is modified to also serve as a compressor head assembly, which is referred to herein simply as head 30. The head 30 has a valve cover 32 attached thereon. The preferred version of the invention has four engine cylinders which remain basically a standard engine for energizing the compressor 10 and include all of the normal engine components such as valves, spark plugs, wiring, etc. For simplicity, these engine components are not illustrated.

Further, the preferred version of the invention has two gas compressor cylinders which are produced by modifying two of the original engine cylinders 14. It is obvious that any two of the engine cylinders 14 may be modified for compression. Further, it is obvious that any number of original engine cylinders may be modified for gas compression.

Figure 4:
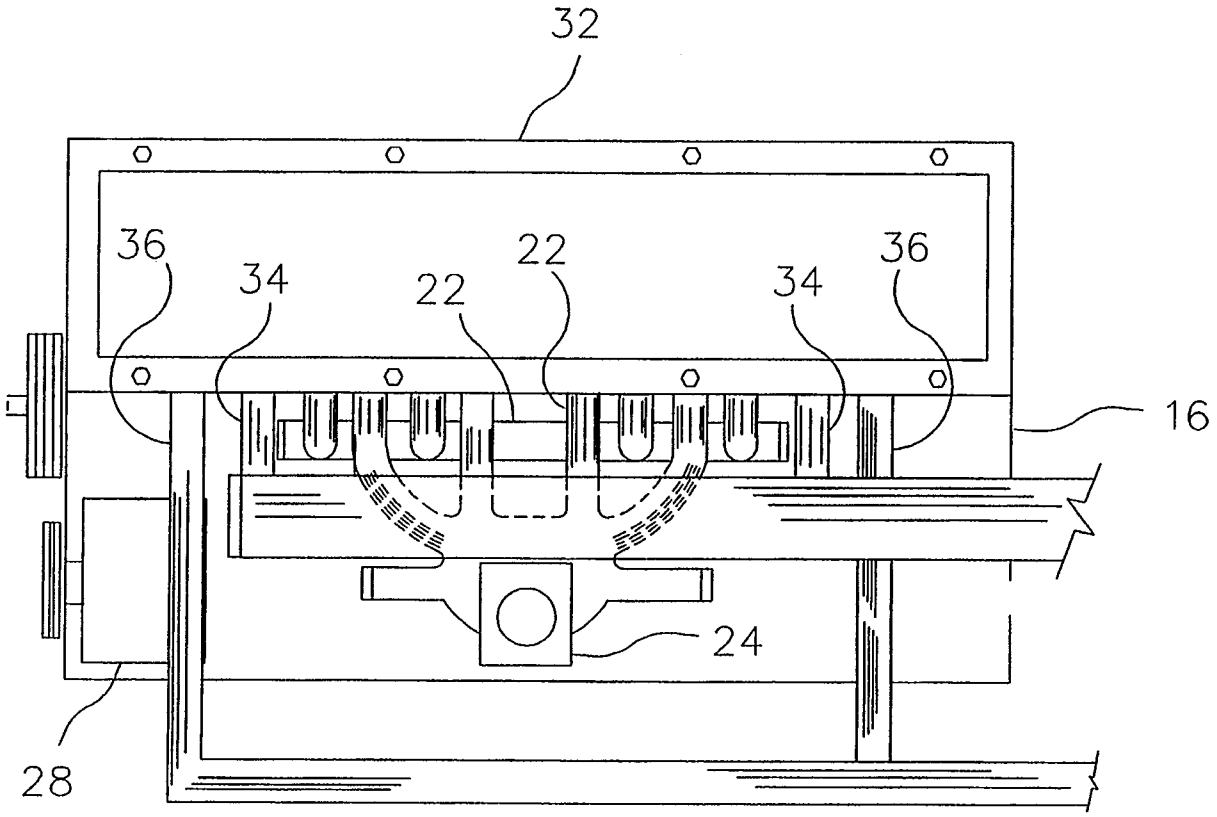
FIG. 4 is a top plan view of the apparatus for compressing gas taken along line 4—4 of FIG. 2, which includes an inline bank of cylinders and manifolding attached thereto.

In FIG. 4, the preferred version includes cylinders 14 modified for compression having their engine intake and exhaust manifold 22 cutoff and capped. The head 30 is attached to the cylinder block 16 adjacent the inline bank of cylinders 14. Connected to the head 30 is a compressor intake manifold 34 and a compressor discharge manifold 36. Modification details of the compressor cylinders and head 30 will be further discussed herein.

Referring again to FIGS. 1 and 2, an inlet tank and liquid separator 38 are attached to the skid 12. An inlet valve 40 is in communication with the tank 38 and is adapted for connection to the source of gas to be compressed. Preferably, the gas is natural gas from a wellhead (not shown). The tank 38 is of a kind generally known in the art and includes a means for separating liquids out of the incoming gas. A dump valve is connected to the tank 38 by a line and is used to drain liquids collected in the tank 38 to any desired location. The top of the tank 38 is connected, using known connectors such as those having flanges, with a line 42 that attaches to the compressor intake manifold 44, wherein the line 42 is an intake gas line to the compressor 10.

Attached to the line 42, with a commonly used connection 44 such as a tee connection, is a hose 46. The hose 46 provides a communication between the compressor 10 and the line 42 wherein natural gas from the tank 38 is used for energizing the compressor 10. Affixed to the hose 46 is a commonly used fuel regulator 48. Further, an additional line (not shown) extends from the crankcase 18 to the engine intake manifold 22; thus, preventing gas buildup in the crankcase 18.

A standard engine radiator 50 is positioned adjacent to the compressor 10 and connected thereto by known radiator hoses. A fan 52, of a type commonly known in the art, is used to draw air across the radiator 50.

An aftercooler of a kind known in the art (not shown) may be used to cool the gas discharged from the compressor 10. The aftercooler is preferably a finned tube type with a fan shroud connected thereto with a cooling fan rotatably disposed therein. A drive shaft extends from the compressor 10 to drive the cooling fan.

A discharge line 54 connects the compressor discharge manifold 36 with the aftercooler. A combination pressure gauge and shutoff switch is disposed in the discharge line 54 to deenergize the engine portion of the compressor 10 if the compressor discharge pressure exceeds a predetermined level.

An electrical control panel for the compressor 10 and associated components is positioned on the skid 12. The control panel is of a kind generally known in the art; wherefor, the electrical control panel and connections thereto are not illustrated.

Referring again to FIG. 3, engine pistons 56 are reciprocally disposed in the cylinders used for energizing the compressor 10, and the engine pistons are connected to a crankshaft 58 by connecting rods 60. The engine pistons 56, crankshaft 58 and connecting rods 60 are the original components of the engine used to construct the compressor 10.

Figure 5A:
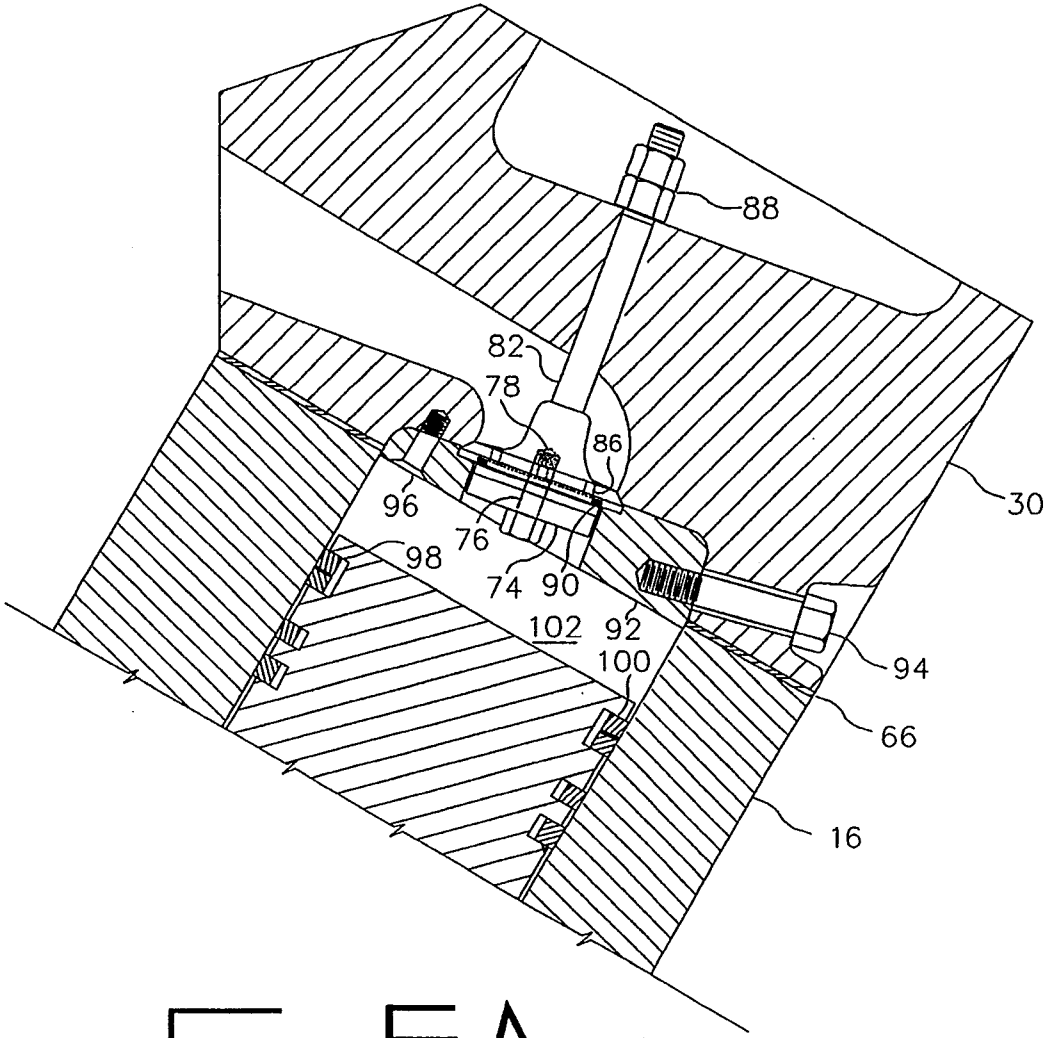
FIG. 5A is a cross section of the compressor cylinder in FIG. 3.
Figure 5B:
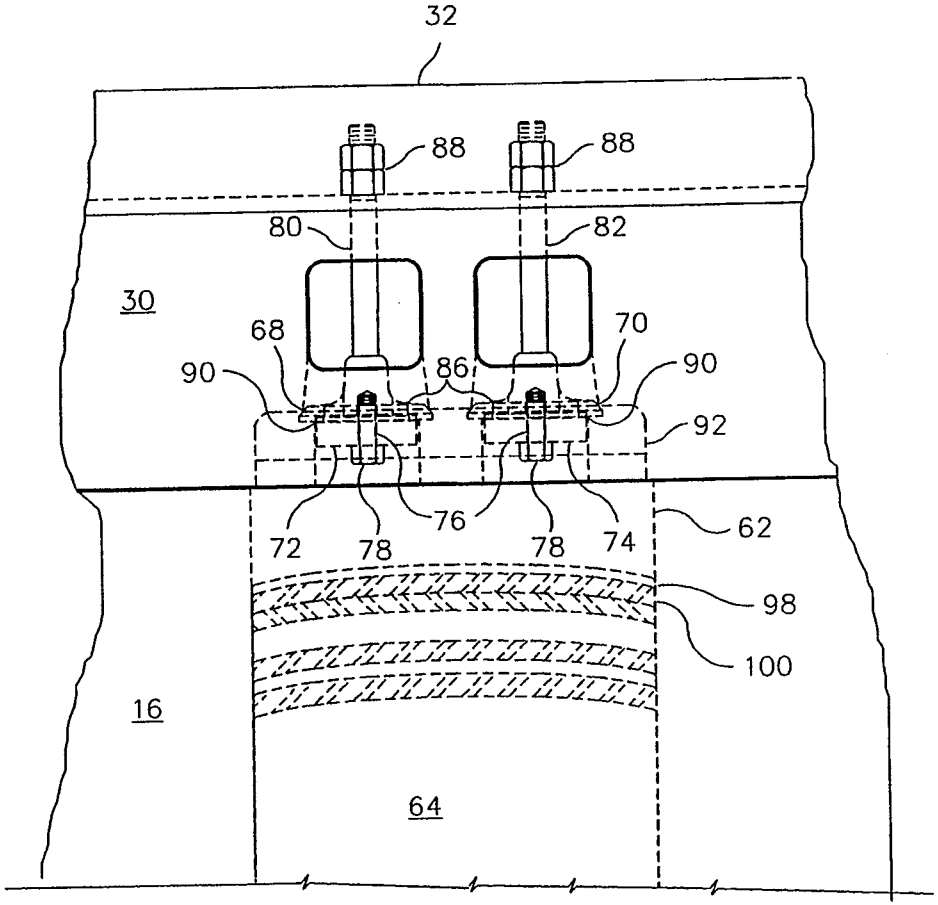
FIG. 5B is a cross section taken along line 5B—5B of FIG. 3, which shows a general side elevation view of the compressor cylinder.
Figure 6:
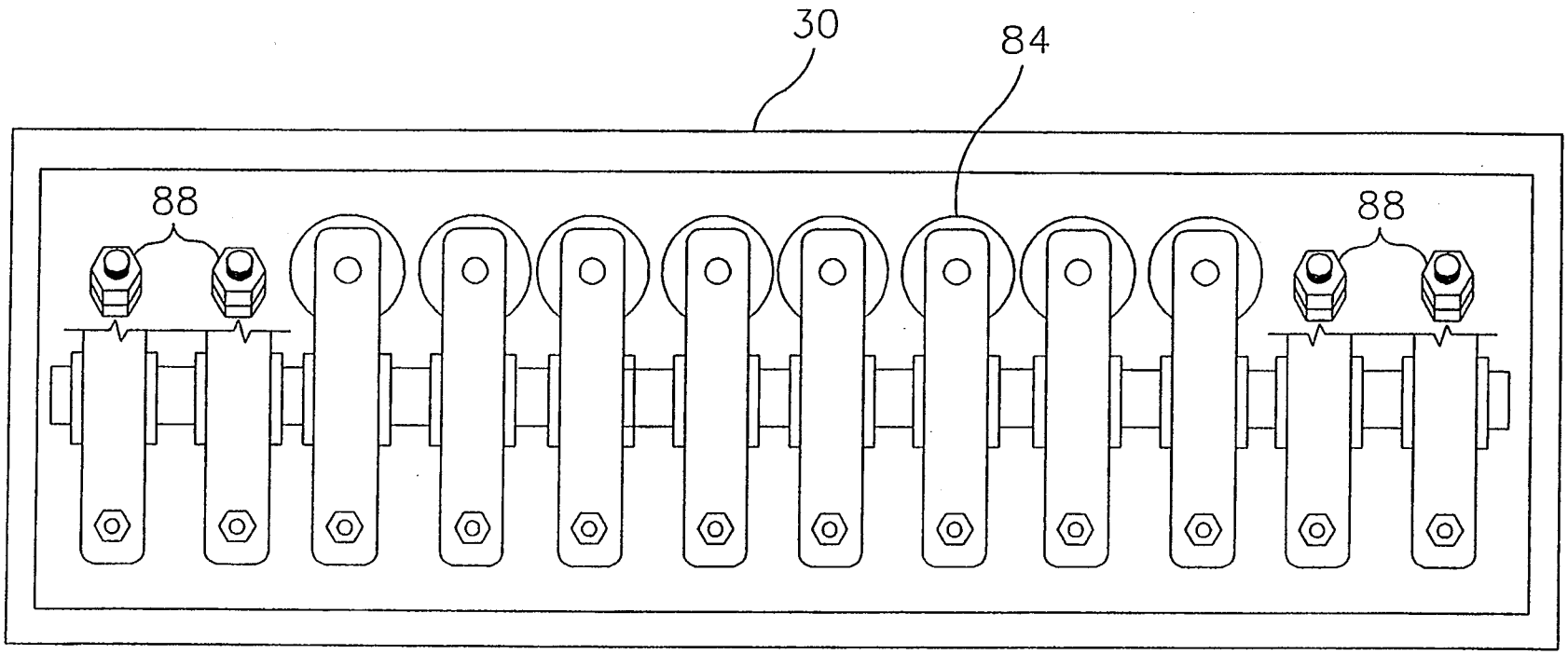
FIG. 6 is a top plan view of the modified engine head assembly having the valve cover removed therefrom.

Turning to FIGS. 5A and 5B, each compressor cylinder 62 has a reciprocally disposed compressor piston 64 disposed therein. Each compressor piston 64 is connected to the crankshaft 58 by additional connecting rods 60. The compressor pistons 64 are modified, as discussed herein, from original engine pistons. The connecting rods 60 and are preferably the same as those used in the original engine.

In FIGS. 5A, 5B, 6 and 7, details of the head 30 and associated components therein will be discussed. The head 30 is positioned adjacent to the cylinder block 16 with a sealing means 66, such as an original engine head gasket, disposed therebetween. The head 30 portion which corresponds with each compressor cylinder 62 includes a first valve pocket 68 for gas intake and a second valve pocket 70 for gas discharge, wherein the valve pockets 68, 70 are substantially coaxial with the corresponding compressor cylinder 62.

An intake compressor valve 72, of a kind generally known in the art, such as a Champion Z113, is disposed in the head 30 adjacent each first valve pocket 68. A discharge compressor valve 74, of a kind generally known in the art, such as a Champion Z115, is disposed in the head adjacent each second valve pocket 70. The intake and discharge compressor valves 72, 74 have an opening 76 for receiving a threaded bolt 78 therethrough. The openings 76 provided in the preferred valves, Champion Z113 and Z115, are increased from 3/16" to $\frac{1}{4}$" in diameter. The bolt 78 is preferably a Grade 5, $\frac{1}{4}$"×$\frac{3}{4}$", National Fine bolt.

Referring to FIG. 5B, original engine intake and discharge valves 80, 82 are removed from the head 30 adjacent each corresponding compressor cylinder 62. The engine rocker arms 84 previously attached to the removed valves 80, 82 remain connected to the engine valve rocker arms 84 but are non-functional with respect to each compressor cylinder 62, see FIG. 6.

Figure 8:
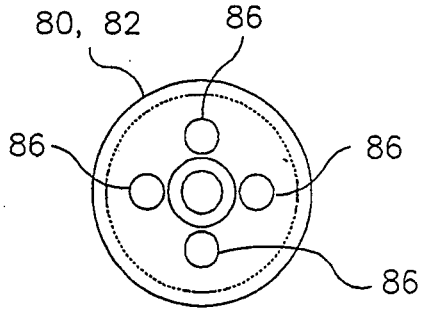
FIG. 8 is a top plan view of the modified engine valve shown in FIG. 5A.

The removed engine intake and exhaust valves 80, 82 are each modified to include an aperture 86, preferably a plurality thereof as shown in FIG. 8, defined therethrough on the portion of the valves 80, 82 located nearest the compressor cylinder 62. The apertures 86 provide a gas flow path.

Figure 9B:
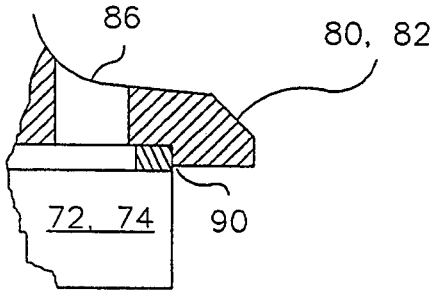
FIG. 9 is a side elevation view of the modified engine valve and attached compressor valve shown in FIG. 5A, with an enlarged portion thereof.
Figure 9A:
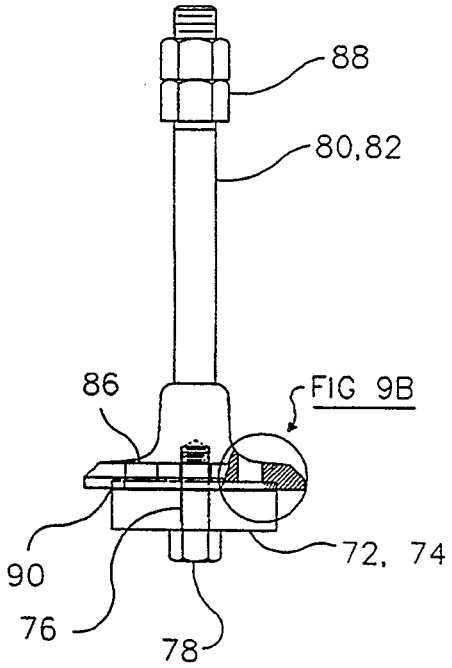

The portion of the removed engine intake and exhaust valves 80, 82 which originally connected the engine valve to the rocker arm is threaded to accept a pair of locknuts 88, as shown in FIG. 9. The modified engine valves are replaced in the head 30. The locknuts 88 securely fasten the modified engine valves 80, 82 to the head 30 where the engine rocker arms originally attached thereto, see FIG. 6.

As illustrated in FIG. 9, the end of the valves 80, 82 which contain the apertures 86, are tapped to receive the threaded bolt 78 therein for securing either the intake or discharge compressor valve 80, 82 thereto. Thus, the modified engine valves serve as either an intake compressor valve securing means 80 or a discharge compressor valve securing means 82, as herein referred, for the intake and discharge compressor valves 72, 74, respectively. Preferably, a copper ring-shaped gasket 90 is inserted between each intake and discharge compressor valve securing means 80, 82 and the respective intake or discharge compressor valve 72, 74 attached thereto.

Figure 7:
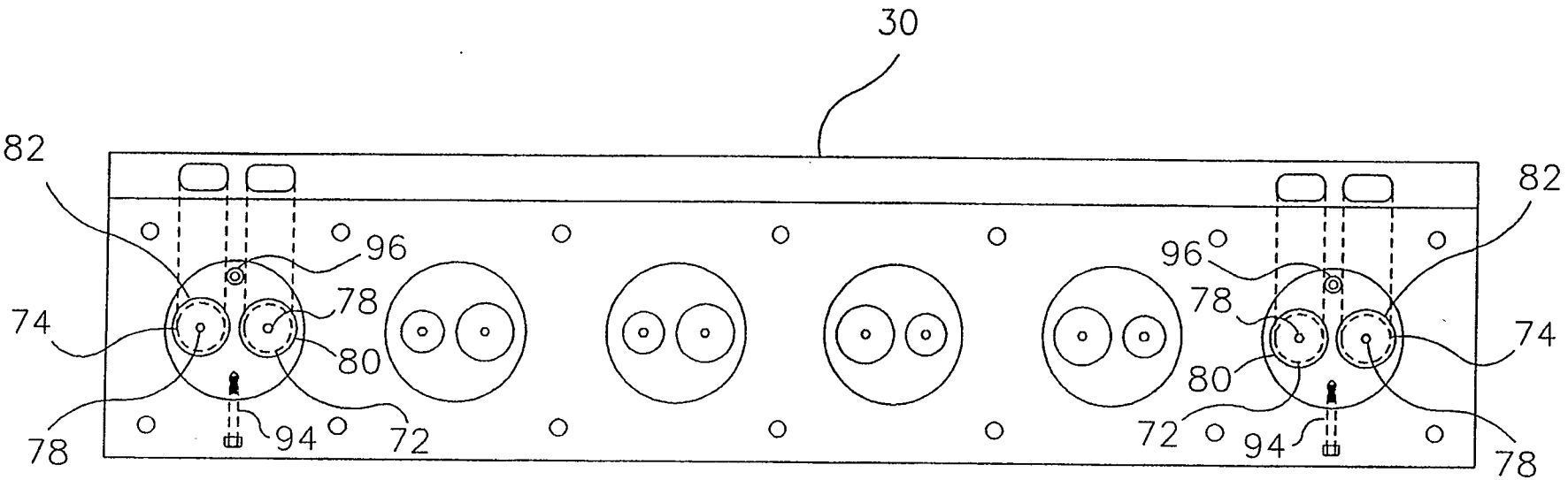
FIG. 7 is a bottom plan view of the modified engine head assembly.

As shown in FIG. 7, the head 30 preferably has a filler plate 92, made of molded cast steel, inserted and attached therein to fill excess space defined in the head 30 adjacent the intake and discharge compressor valves 72, 74. Obviously, the intake and discharge compressor valves 72, 74 must remain in communication with the compressor cylinder 62.

As shown in FIGS. 5A, 5B and 7, the filler plate 92 is attached to the head 30 with a first bolt 94 secured through the original spark plug hole and connected to the filler plate 92. A second bolt 96 is inserted through the filler plate 92 from the side adjacent the compressor cylinder 62 and extends into the head 30. The filler plate 92 provides increased gas compression in the compressor cylinder 62.

As previously discussed and as shown in FIG. 4, the compressor intake manifold 34 is attached to the head 30 adjacent each first valve pocket 68. The compressor intake manifold 34 is in communication with the intake compressor valve securing means 80 and aperture 86 defined therethrough such that the gas can pass into the compressor cylinder 62 via the intake compressor valve 72.

The compressor discharge manifold 36 is attached to the head 30 adjacent each second valve pocket 70. The compressor discharge manifold 36 is in communication with the discharge compressor valve securing means 82 and aperture 86 defined therethrough such that the gas can pass from the compressor cylinder 62 via the discharge compressor valve 74 and on to a downstream location. In addition, the compressor intake and discharge manifolds 34, 36 utilize the original engine manifold gasket for sealing the head 30 to the compressor intake and discharge manifolds 34, 36.

Referring to FIGS. 5A and 5B, the compressor piston 64 is produced from an original engine piston having a plurality of piston grooves defined thereon. Disposed in a first groove 98, which is located nearest the head 30 and widened to accept an additional piston ring 100, is a pair of piston rings. The piston rings are positioned such that any circumferential gaps in the piston rings are substantially diametrically opposed from one another so that gas leakage by the piston rings into the crankcase 18 of the compressor 10 is minimized.

Referring now to an oil pressure sensing system (not illustrated) that is commonly known in the art and is preferably used with the compressor 10. A switch gauge, such as a Murphy 20P-50, is used with a Murphy 518 APH 12V for deenergizing the apparatus when the oil pressure drops below a predetermined level.

In an alternative embodiment which is not illustrated, the apparatus for compressing gas includes having all of the engine cylinders 14 modified into compressor cylinders 62, as previously described and illustrated in FIGS. 5A and 5B, and manifolded for gas intake and discharge. The alternative version of the present invention, is preferably energized by a separate internal combustion engine connected thereto by drive means known in the art; however, it is obvious that other energizing means such as an electric motor may be used.

OPERATION OF THE INVENTION

After the engine has been converted to form the compressor 10 and is installed with associated components, it is ready for operation such as the compression of natural gas from a wellhead. A line from the wellhead is connected to the inlet valve 40 on the tank 38 and connection is also made from the tank 38 to carburetor 24 and intake compressor manifold 34. Similarly, the discharge line 54 is connected to whatever is downstream, such as a storage vessel or pipeline.

The fuel regulator 48 insures that the fuel pressure at the carburetor 24 is maintained at a constant, predetermined level as required by the carburetor 24. Additionally, the governor 28 is used to control the speed of the compressor 10.

The engine cylinders 14 operate in a normal manner to rotate the crankshaft 58, and thus, operate the compressor cylinders 62, see FIG. 3. In this way, the compressor pistons 64 are reciprocated within the compressor cylinders 62.

As previously described, the gas enters the intake manifold 34 of the compressor 10 through the line 42. The gas is then in communication with each of the intake valve securing means 82, and thus in communication with each of the compressor intake valves 72.

Referring now to FIGS. 5A and 5B, as the compressor piston 64 moves downwardly from its top dead center position, a variably sized volume 102 is formed in the compressor cylinder 62. When the pressure in the volume 102 drops below that of the incoming gas, a pressure differential is formed across the intake compressor valve 72. When the force exerted by this pressure differential exceeds that exerted by the intake compressor valve 72, the intake compressor valve 72 will move to its open position and the gas will flow through the aperture 86 in the intake compressor valve securing means 80 and through the intake compressor valve 72 thereby entering into the volume 102. When the pressure of the incoming gas and the gas within the volume 102 are substantially equalized, the intake compressor valve 72 closes and shuts off the intake of gas into the volume 102.

As the compressor piston 64 reaches its bottom dead center position, and starts to move upwardly again within the compressor cylinder 62, the gas in the volume 102 is obviously compressed. Eventually, the gas in the volume 102 exceeds the downstream pressure such that a pressure differential exceeds that exerted by the discharge compressor valve 74. When the force exceeds that exerted by the discharge compressor valve 74, the discharge compressor valve 74 is moved into an open position so that the compressed gas is forced out of the volume 102 through the discharge compressor valve 74 and through the aperture 86 defined in the discharge compressor valve securing means 82. Thus, the compressed gas moves downstream via the compressor discharge manifold 36. When the pressures in the volume 102 and the discharge gas path are substantially equalized, the discharge compressor valve 74 will return to its normal closed position, so the cycle may start again.

The gas transferred by the compressor 10 is discharged through the discharge manifold 36 and into the discharge line 54. If the compressed gas is at an elevated temperature then the aftercooler is preferably used before eventual discharge to the downstream location through the discharge line 54.

Even though the compressor piston rings 100 are designed to minimize leakage thereby, there may be some gas leakage, and the result is gas buildup in the crankcase 18 of the compressor 10. The crankcase 18 is the original component and is not designed for significant pressurization, so a means is provided to vent the crankcase 18. In the case of flammable or other hazardous gases, obviously this venting cannot be to the atmosphere. In the preferred version of the invention, the gas is vented to the engine intake manifold 22.

Even with the venting of the crankcase 18, the low pressure gas that is present will eventually result in some contamination of the engine oil. Thus, the present invention includes an oil pressure sensing means to prevent damage to the compressor when the oil pressure falls below a predetermined level.

The previously described versions of the invention disclose a novel form of the compressor 10 which is constructed from an inline-cylinder engine and is particularly adaptable for providing an engine to compression cylinder ratio of more than one to one.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for compressing gas, comprising:

a cylinder block having a plurality of cylinder bores in a single bank, wherein one or more of the cylinder bores is used for energizing the apparatus and one or more of the cylinder bores is used for compressing gas;

a crankshaft rotatably disposed in said cylinder block;

an engine piston disposed in each of the cylinder bores used for energizing the apparatus;

a compressor piston disposed in each of the cylinder bores used for compressing gas;

a plurality of connecting rods for connecting said engine pistons and said compressor pistons to said crankshaft;

a head attached to said cylinder block, wherein said head is adjacent the cylinder bores;

an engine manifold attached to said head;

an intake compressor valve pocket located in said head adjacent each cylinder bore used for compressing gas;

a discharge compressor valve pocket located in said head adjacent each cylinder bore used for compressing gas;

a gas intake manifold attached to said head;

a gas discharge manifold attached to said head;

a sealing means for sealing said engine manifold, said gas intake manifold and said gas discharge manifold to said head;

an intake compressor valve securing means located in said intake compressor valve pocket, wherein said intake valve securing means has a gas intake flow path in communication with said gas intake manifold;

a means for securing said intake compressor valve securing means in said intake compressor valve pocket;

an intake compressor valve;

a means for attaching said intake compressor valve to said intake valve securing means, wherein said intake compressor valve is in communication with the gas intake flow path;

a discharge compressor valve securing means located in said discharge compressor valve pocket, wherein said discharge valve securing means has a gas discharge flow path in communication with said gas discharge manifold;

a means for securing said discharge compressor valve securing means in said discharge compressor valve pocket;

a discharge compressor valve; and a means for attaching said discharge compressor valve to said discharge valve securing means, wherein said discharge compressor valve is in communication with the gas discharge flow path.

2. The apparatus of claim 1, wherein said cylinder block comprises:

a greater number of cylinder bores used for energizing the apparatus than for compressing gas.

3. The apparatus of claim 1, wherein said cylinder block comprises:

four cylinder bores for energizing the apparatus; and two cylinder bores for compressing gas.

4. The apparatus of claim 1, wherein said head comprises:

a combined engine and compressor head assembly.

5. The apparatus of claim 1, wherein said sealing means for sealing said engine manifold, said gas intake manifold and said gas discharge manifold to said head comprises:

an engine manifold sealing means.

6. The apparatus of claim 1, wherein said intake valve securing means and said discharge valve securing means comprise:

modified engine valves.

7. The apparatus of claim 1, wherein said means for securing said intake compressor valve securing means in said intake compressor valve pocket and said means for securing said discharge compressor valve securing means in said discharge compressor valve pocket comprise:

said intake compressor valve securing means and said discharge compressor valve securing means each having a threaded portion thereon for accepting a locknut; and a locknut for each intake and discharge compressor valve securing means.

8. The apparatus of claim 1, wherein said means for attaching said intake compressor valve to said intake valve securing means and said means for attaching said discharge compressor valve to said discharge valve securing means comprise:

said intake compressor valve and said discharge compressor valve each having an opening defined therethrough;

said intake compressor valve securing means and said discharge compressor valve securing means each having a means for accepting a bolt; and a bolt for each intake and discharge compressor valve.

9. The apparatus of claim 1, further comprising:

a filler plate in said head adjacent each cylinder bore used for compressing gas.

10. The apparatus of claim 1, further comprising:

an intake compressor valve sealing means located between said intake compressor valve and said intake compressor valve securing means; and a discharge compressor valve sealing means located between said discharge compressor valve and said discharge compressor valve securing means.

11. The apparatus of claim 10, wherein said intake compressor valve sealing means and said discharge compressor valve sealing means comprise:

a gasket located between said intake compressor valve and said intake compressor valve securing means; and a gasket located between said discharge compressor valve and said discharge compressor valve securing means.

12. The apparatus of claim 1, further comprising:

a venting means for venting gas in said cylinder block to said engine manifold.

13. The apparatus of claim 1, further comprising:

a sensing means for sensing a pressure of lubricating oil in said cylinder block.

14. An apparatus for compressing gas, comprising:

a cylinder block having a plurality of cylinder bores in a single bank;

a crankshaft rotatably disposed in said cylinder block;

an engine piston disposed in said cylinder block, wherein the engine piston is used for energizing the apparatus;

a compressor piston disposed in said cylinder block, wherein the compressor piston is used for compressing gas;

a plurality of connecting rods for connecting said engine piston and said compressor piston to said crankshaft;

a gas intake manifold attached to the apparatus for delivering gas thereto;

a gas discharge manifold attached to the apparatus for removing compressed gas therefrom;

an intake compressor valve;

an intake compressor valve securing means for securing said intake compressor valve in the apparatus, wherein said intake compressor valve securing means has a gas intake flow path in communication with said gas intake manifold;

a discharge compressor valve; and a discharge compressor valve securing means for securing said discharge compressor valve in the apparatus, wherein said discharge compressor valve securing means has a gas discharge flow path in communication with said gas discharge manifold.

15. The apparatus of claim 14, wherein said cylinder block comprises:

a greater number of cylinder bores used for energizing the apparatus than for compressing gas.

16. The apparatus of claim 14, wherein said cylinder block comprises:

four cylinder bores for energizing the apparatus; and two cylinder bores for compressing gas.

17. The apparatus of claim 14, further comprising:

a combined engine and compressor head assembly, said head assembly is attached to said cylinder block.

18. The apparatus of claim 17, further comprising:

a filler plate in said head assembly, said filler plate is adjacent the cylinder bore used for compressing gas.

19. The apparatus of claim 14, further comprising:

a sealing means for sealing said gas intake manifold and said gas discharge manifold to the apparatus.

20. The apparatus of claim 14, further comprising:

a vent for venting gas in said cylinder block to the energizing cylinder.

21. The apparatus of claim 14, further comprising:

a sensing means for sensing a pressure of lubricating oil in said cylinder block.

22. An apparatus for compressing gas, comprising:

a cylinder block having a plurality of cylinder bores in a single bank;

wherein one of the cylinder bores contains an engine piston for energizing the apparatus;

wherein one of the cylinder bores contains a compressor piston for compressing gas;

a combined engine and compressor head assembly, said head assembly is attached to said cylinder block;

a crankshaft rotatably disposed in said cylinder block;

a plurality of connecting rods for connecting said engine piston and said compressor piston to said crankshaft;

a gas intake manifold attached to the apparatus for delivering gas thereto;

a gas discharge manifold attached to the apparatus for removing compressed gas therefrom;

an intake compressor valve;

an intake compressor valve securing means for securing said intake compressor valve in the apparatus, wherein said intake compressor valve securing means has a gas intake flow path in communication with said gas intake manifold;

a discharge compressor valve; and a discharge compressor valve securing means for securing said discharge compressor valve in the apparatus, wherein said discharge compressor valve securing means has a gas discharge flow path in communication with said gas discharge manifold.

23. The apparatus of claim 22, wherein said cylinder block comprises:

a greater number of cylinder bores used for energizing the apparatus than for compressing gas.

24. The apparatus of claim 22, wherein said cylinder block comprises:

four cylinder bores for energizing the apparatus; and two cylinder bores for compressing gas.

25. The apparatus of claim 22, further comprising:

a filler plate in said head assembly, said filler plate is adjacent the cylinder bore used for compressing gas.

26. An apparatus for compressing gas, comprising:

an internal combustion engine having a plurality of cylinder bores in a single bank;

an engine piston located in said internal combustion engine, wherein the engine piston is used for energizing the apparatus;

a compressor piston located in said internal combustion engine, wherein the compressor piston is used for compressing gas;

a gas intake manifold attached to the apparatus for delivering gas thereto;

a gas discharge manifold attached to the apparatus for removing compressed gas therefrom;

an intake compressor valve;

an intake compressor valve securing means for securing said intake compressor valve in the apparatus, wherein said intake compressor valve securing means has a gas intake flow path in communication with said gas intake manifold;

a discharge compressor valve; and a discharge compressor valve securing means for securing said discharge compressor valve in the apparatus, wherein said discharge compressor valve securing means has a gas discharge flow path in communication with said gas discharge manifold.

* * * * *